US006935497B1

(12) United States Patent
Domotor et al.

(10) Patent No.: US 6,935,497 B1
(45) Date of Patent: Aug. 30, 2005

(54) PERSONAL DIGITAL ASSISTANT POCKET EJECTOR

(75) Inventors: Agnes Csilla Domotor, Jamaica Plain, MA (US); Mark T. Salander, Barrington, RI (US)

(73) Assignee: The Gem Group, Lawrence, MA (US)

( * ) Notice: Subject to any disclaimer, the term of this patent is extended or adjusted under 35 U.S.C. 154(b) by 0 days.

(21) Appl. No.: 10/441,878

(22) Filed: May 20, 2003

(51) Int. Cl.[7] ..... B65D 85/00
(52) U.S. Cl. ..... 206/320; 206/224; 206/232
(58) Field of Search ..... 206/320, 223, 206/804, 224, 232, 472, 473, 37, 36, 39.4, 206/477, 305; 150/154, 165

(56) References Cited

U.S. PATENT DOCUMENTS 1,206,124 A * 11/1916 Meyers ..... 206/254
1,463,619 A * 7/1923 Gardner ..... 206/39.4
1,585,051 A * 5/1926 Skoglund ..... 206/39.4
3,589,505 A * 6/1971 Burniski ..... 206/250
4,609,084 A * 9/1986 Thomas ..... 190/110
4,722,462 A * 2/1988 Zinnbauer ..... 222/183
5,330,056 A * 7/1994 de la Rocha ..... 206/581
5,915,545 A * 6/1999 Shackel et al. ..... 206/5.1
6,161,979 A * 12/2000 Yamamoto et al. ..... 402/73
6,264,029 B1 * 7/2001 Motson ..... 206/320
6,305,540 B1 * 10/2001 Crawford et al. ..... 206/320
6,501,643 B1 * 12/2002 Sayers et al. ..... 361/683
6,595,687 B2 * 7/2003 Godshaw et al. ..... 383/6

* cited by examiner

*Primary Examiner*—Shian T. Luong
(74) *Attorney, Agent, or Firm*—Cesari and McKenna, LLP; William A. Loginov

(57) ABSTRACT

A pouch for a padfolio or other business accessory that encloses a PDA or other electronic device with an extraction or ejection strap having a pull-tab exposed on the top face of the pouch is provided. The pull-tab is connected to an outer free end of the strap, and the strap extends around the bottom of the device within the interior of the pocket. The strap is secured to an opposing bottom face interior of the pouch. When the tab is pulled, the strap engages the bottom of the device and urges the device upwardly out of the opening so that it can be grasped easily at its top end, which now extends from the opening. The top face of the pouch, as well as the side walls, can be sized so that the device is fully enclosed by the pouch for better security. The slot on the top face of the pouch from which the strap and pull-tab extend can be reinforced with a gusset formed from a durable material, such as soft polyvinylchloride (PVC). The pouch can be fixed to the base of the padfolio or can be removably attached to the padfolio using, for example, a hook and loop fastener material.

8 Claims, 4 Drawing Sheets

PERSONAL DIGITAL ASSISTANT POCKET EJECTOR

BACKGROUND OF THE INVENTION

1. Field of the Invention

This invention relates to padfolios and other business accessories and more particularly to pouches and pockets for holding electronic devices in padfolios and other business accessories.

2. Background Information

Bags, padfolios and other business accessories often contain a variety of pockets and flaps for holding various items. Often, a notepad is provided in a special space along a flap. In addition, permanent or detachable pockets can be provided for telephones, personal digital assistants (PDAs), calculators and a variety of card-sized items.

Many padfolio designs include a peripheral closure, such as a zipper, that allows the interior of the padfolio to be sealed when not in use. The zipper often defines a raised wall that allows the two outer covers of the padfolio to be separated from each other by a distance that creates a gap space between the covers, allowing electronic devices such as telephones and PDAs to be enclosed within the space. For convenience, pouches for PDAs and telephones (among other devices) may be open at the top (e.g. lacking a separate pouch cover), thereby allowing quicker access to the device when needed. However, to fully secure and protect the device, the pouch may be cut so as to fully enclose the sides of the device—i.e. so that the device's top does not extend from beyond the pouch opening. In addition, pouches are often cut to a standard size (and often slightly over-sized to accommodate a range of device form factors). Thus, many devices may have a lower profile, causing their tops to be recessed within the pouch. In either event, it may be difficult to retrieve the electronic device from within the pouch or pocket when needed. In particular, when the user has long fingernails, it becomes even more difficult and fingernail breakage is likely. Accordingly, it is desirable to provide a mechanism for quickly retrieving a PDA or other electronic device from a padfolio pouch while still allowing the pouch to fully enclose the device for maximum protection.

SUMMARY OF THE INVENTION

This invention overcomes the disadvantages of the prior art by providing a pouch for a padfolio or other business accessory that encloses a PDA or other electronic device with an extraction or ejection strap having a pull-tab exposed on the top face of the pouch. The pull-tab is connected to an outer free end of the strap, and the strap extends around the bottom of the device within the interior of the pocket. The strap is secured to an opposing bottom face interior of the pouch. When the tab is pulled, the strap engages the bottom of the device and urges the device upwardly out of the opening, away from the pouch bottom, so that it can be grasped easily at its top end, which now extends from the opening. The top face of the pouch, as well as the side walls, can be sized so that the device is fully enclosed by the pouch for better security. The slot on the top face of the pouch from which the strap and pull-tab extend can be reinforced with a gusset formed from a durable material, such as soft polyvinylchloride (PVC). The pouch can be fixed to the base of the padfolio or can be removably attached to the padfolio using, for example, a hook and loop fastener material.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
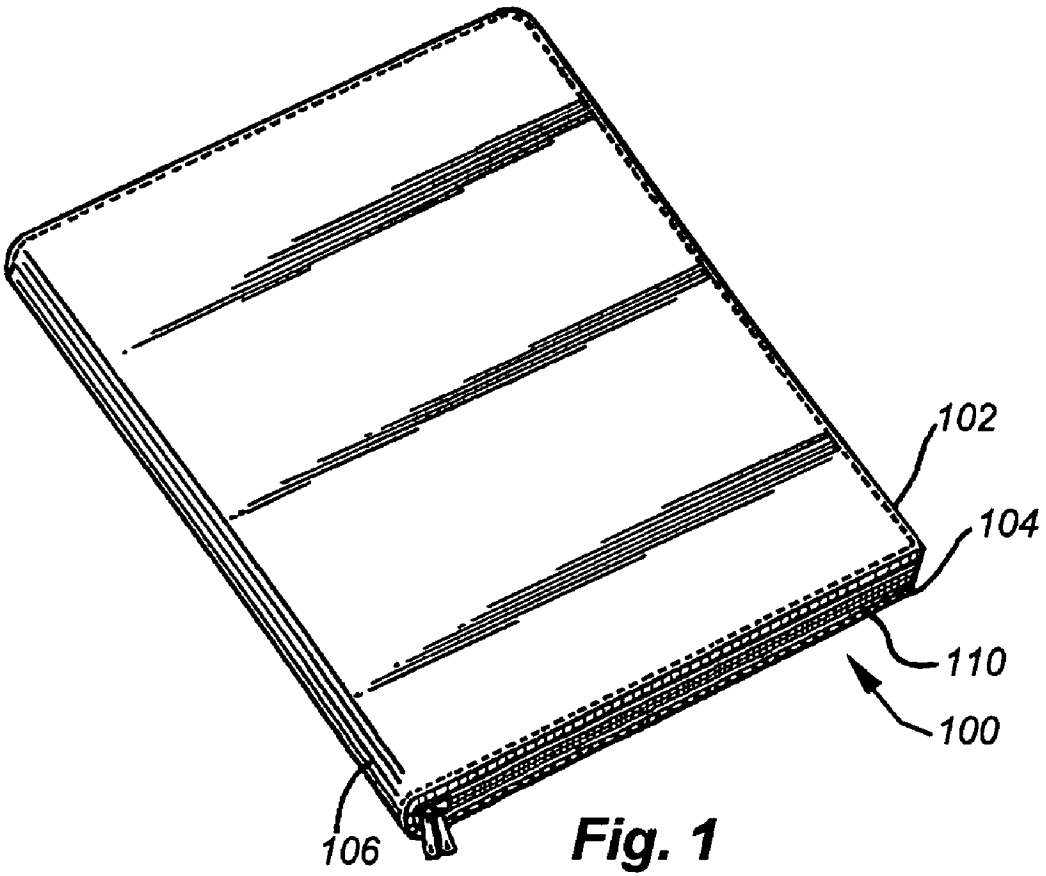
FIG. 1 is an isometric view of a padfolio having a pouch with an ejection mechanism according to an illustrative embodiment in a closed position.

A padfolio 100 is shown in FIG. 1 in a closed orientation. The padfolio 100 includes a pair of opposing top and bottom (or front and back) outer covers 102 and 104, respectively, joined together at a spine 106 and sealed using a zipper closure mechanism 110. A variety of decorative and/or functional pockets, seams and other features (not shown) can be provided on one or both of the outer covers 102 and 104.

Figure 2:
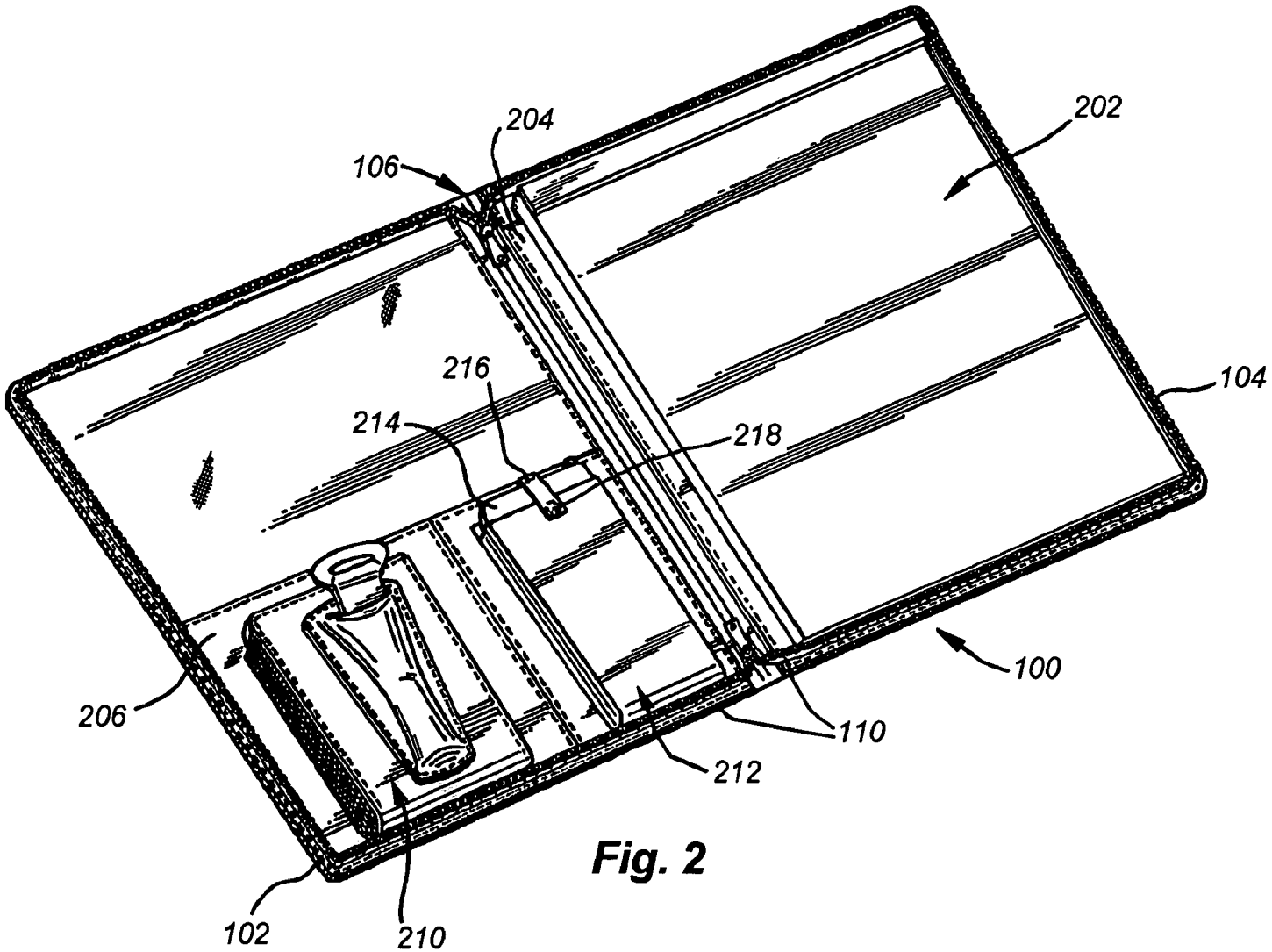
FIG. 2 is an isometric view of the padfolio of FIG. 1 shown in an open position, exposing the pouch.

In FIG. 2 the padfolio 100 is shown with the zipper closure fully opened and the covers 102 and 104 separated. Along the inside of the bottom cover 104 is mounted a notepad 202. The hard cardboard spine (not shown) of the notepad 202 is slipped through a pocket 204 formed on the inside of the bottom cover 104. Along the inside of the top cover, an inside pocket 206 is also provided for storage of loose papers and other flat items. On top of the pocket 206 are placed a pair of pouches 210 and 212. The narrower pouch 212 is adapted to enclose a cellular telephone 214, and has a conventional flap closure 216. The closure can include a tab 218 with a snap or interengaging hook and loop fastener assembly. Note that the pocket arrangement shown in FIG. 2 is merely exemplary, and a variety of other arrangements of pockets and pouches can be provided depending on the style and purpose of the padfolio. In other embodiments, the telephone pouch 212 can be omitted, and a variety of other pockets of various sizes and shapes can be provided.

The zipper closure 110 extends outwardly from each opposing outer cover 102 and 104 so that, when closed, the interior gap space between the covers 102, 104 is sufficient to provide room for the pouches 210 and 212. In one embodiment, the spacing can be approximately 1 inch. The spine 106 is sized to accommodate this gap space.

Figure 3:
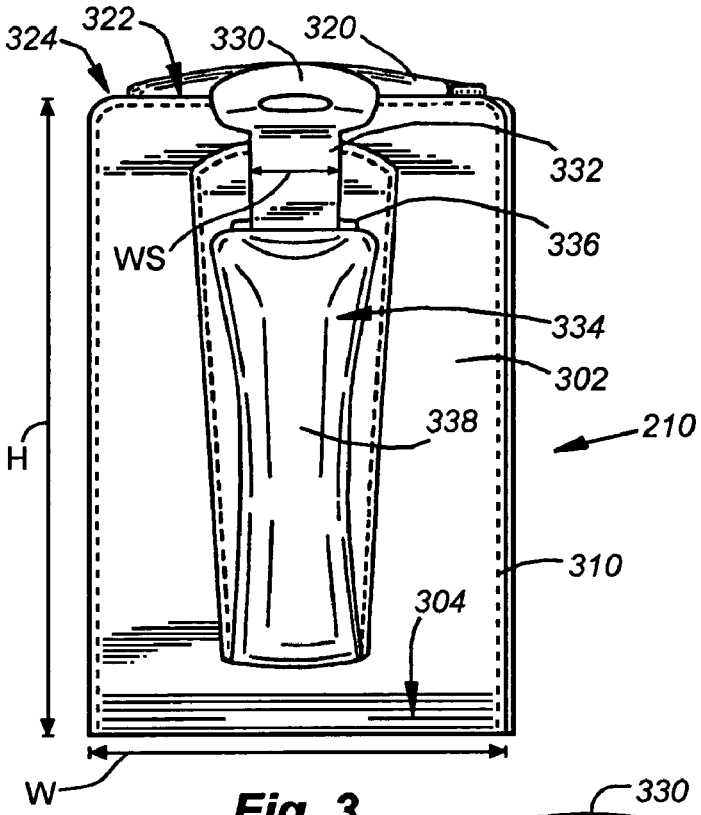
FIG. 3 is a more detailed plan view of the pouch and ejection mechanism with an exemplary PDA in a fully enclosed position.
Figure 4:
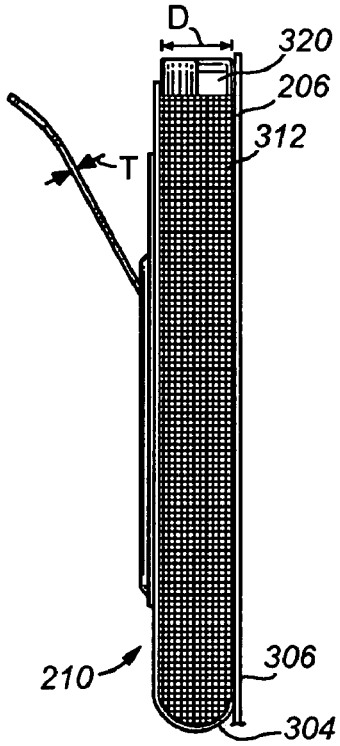
FIG. 4 is a side view of the pouch and ejection mechanism of FIG. 3.

According to the illustrative embodiment of this invention, the pouch 210 encloses an electronic device that, in this example, is a personal digital assistant (PDA). With further reference to FIGS. 3 and 4, the pouch 210 is shown in further detail. The pouch 210 includes a top face 302 that, in this embodiment, extends around a curved bottom 304 to be joined to a bottom face 306. The bottom face 306 can be formed as part of the padfolio's interior pocket 206 along the inner side of the top cover 102. Alternatively, the bottom face 306 can be any other portion of the top cover interior. By use of stitching or other attachment techniques (see stitching 310), the top face 302 and bottom face 306 are joined together along their sides by a woven material 312. This material can be elastic in one embodiment and can have a depth D that is, in an unstretched shape, slightly less than the thickness of the device (PDA) 320 stored within the pouch 210. In this manner, when the PDA is slipped into the pouch, it is held firmly between the top and bottom faces 302 and 306. In another embodiment, the sides of the pouch can be formed from another non-elastic material, such as vinyl or leather. Likewise, the top and bottom faces 302 and 306 can be formed from a variety of materials including, but not limited to, vinyl, imitation leather or natural leather. The overall height H and width W of the pouch (particularly the top face 302) are sized to accommodate most common PDAs. The pouch can be custom-fitted to accommodate particular brands of PDA, or can be sized to a standard that accommodates the largest sized PDA (or other appropriate electronic device for which the pocket is intended). In one example, the width W is between approximately 3 and 4 inches, while the height H is between approximately 4 and 6 inches. However, the width W and height H are highly variable.

As shown in FIGS. 3 and 4, the exemplary PDA is substantially covered or enclosed by the pouch. By "substantially covered" or "substantially enclosed," it is meant that a small portion of the PDA (see portion 322) may still extend outwardly beyond the open top of the pocket, but it is generally an inconveniently small amount by which to grasp the PDA and remove it. The terms "substantially covered" or "substantially enclosed" are also meant to include instances where the PDA is fully covered or obscured by the pocket so that no portion is visible extending above the open top 324.

A pull-tab 330 projects from the top face 302 of the pouch 210. The pull-tab 330 is connected to a strap 332 that is of approximately constant width along its length. The strap 332 passes through a gusset 334 constructed from a soft, pliable material such as "soft" polyvinylchloride (PVC). A slot 336 near the top of the gusset allows the strap 332 to pass into the interior of the pouch, as described further below. An elongated raised section 338 is provided along the length of the gusset below the slot 336 extending toward the bottom curve 304 of the pouch. This raised portion 338 can be stylized as shown, but provides reinforcement so that the strap does not damage the material of the top face 302. The strap 332 can have a thickness T of between approximately 1/32 and 1/16 inch. Other thicknesses, however, are contemplated, depending upon the strength and performance of the material. The strap material can be a flexible, semi-rigid plastic, which is typically smooth and exhibits relatively low-friction characteristics. In one embodiment, the plastic can be reinforced with internal fibers to improve longevity and rigidity. One such material is polyethylene (PE) sheet. The width WS of the strap is highly variable. In one embodiment it is from between approximately 1/2 inch and 3/4 inch. Note that, in this embodiment, the gusset 334 is stitched to the top face 302. It can be attached by a variety of alternate techniques including adhesives and welding.

Figure 5:
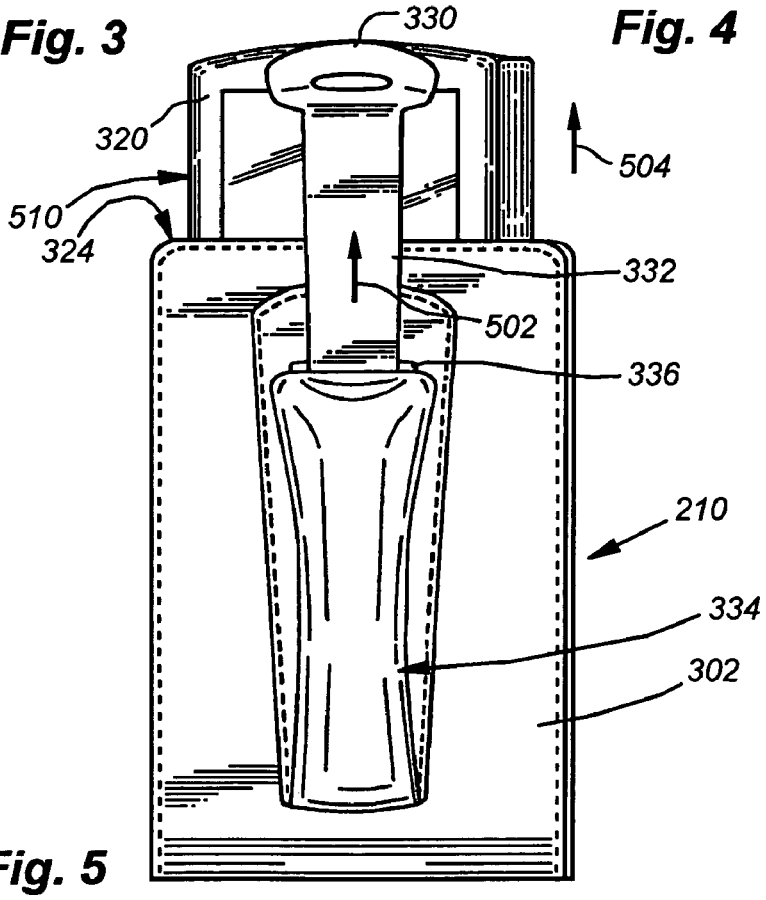
FIG. 5 is a plan view of the pouch and ejection mechanism of FIG. 3 showing the pull-tab extended with the exemplary PDA partially exposed.

FIG. 5 illustrates the generalized function of the pull-tab 330 and strap 332. When the pull-tab is drawn away (arrow 502) from the top opening 324 of the pouch 210, the PDA 320 is, likewise, drawn (arrow 504) from the top opening 324. In one embodiment, the PDA can be extracted between 1 and 3 inches out of the top opening so that its top portion is easily grasped by the fingers. In operation, withdrawal of the PDA entails grasping of the pull-tab 330 with one hand, pulling of the pull-tab in the direction of the arrow 502 so as to expose the top portion 510 of the PDA 320. The PDA can then be grasped with an alternate hand or with the same hand after releasing the pull-tab 330. Internal friction generally retains the PDA in an exposed/extended position relative to the pouch's open top 324 until it is grasped. Return of the PDA into its pouch 210 requires simply that it be directed downwardly, in a direction opposite arrow 504, so that the tab 330 and strap 332 retract under the urging of the bottom (see 602 in FIG. 6) of the PDA as it is directed downwardly toward the pouch bottom 304.

Figures 6, 7, 8:
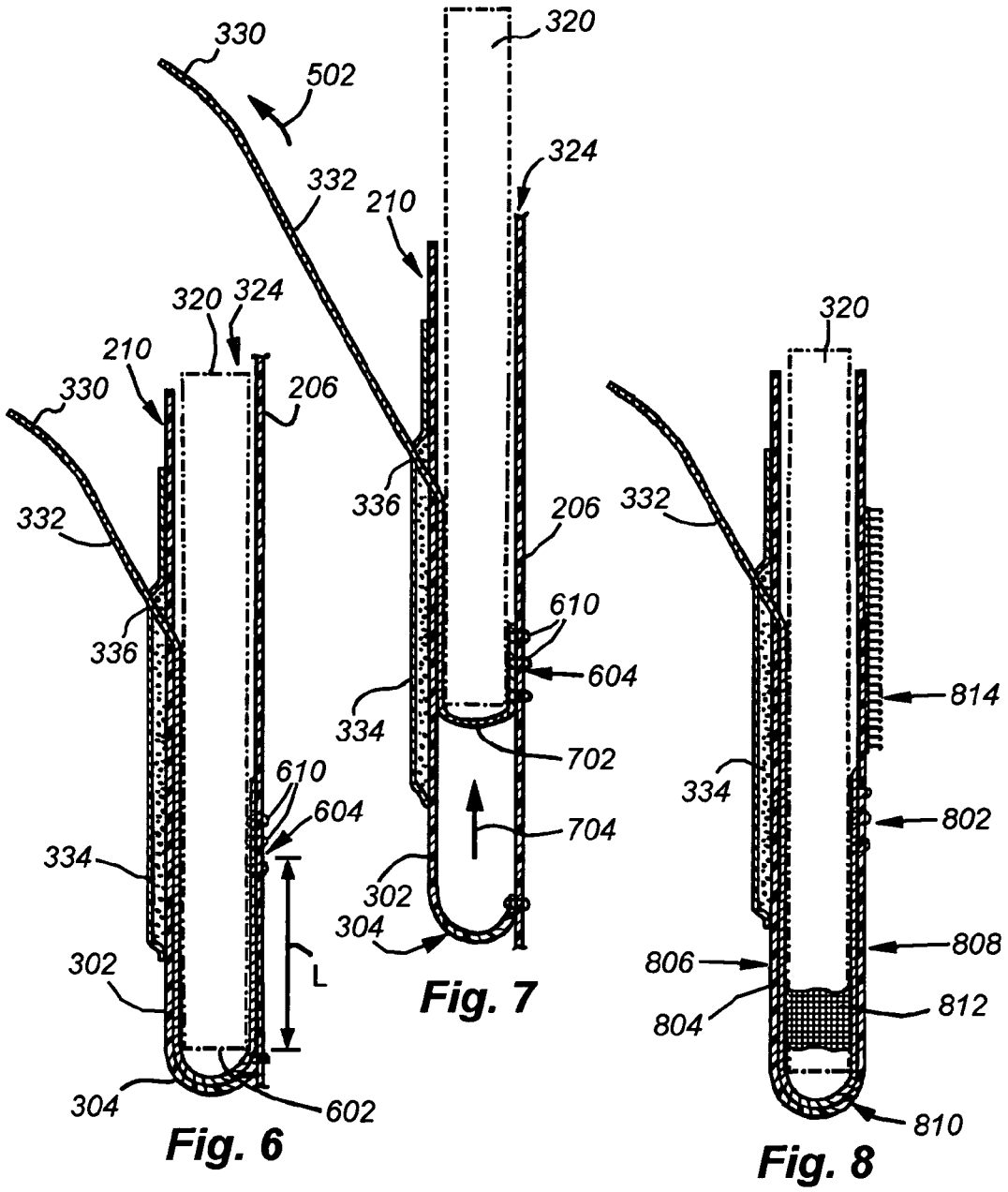
FIG. 6 is a side cross section of the pouch of FIG. 3 with the exemplary PDA fully enclosed.
FIG. 7 is a side cross section of the pouch and ejection mechanism of FIG. 3 with the pull-tab extended and the PDA partially exposed.
FIG. 8 is a side cross section of a removable pouch and ejection mechanism with the exemplary PDA fully enclosed.

The internal structure of the strap 332 and associated pouch interior is described in greater detail in FIGS. 6 and 7 in which the PDA is shown in either a substantially enclosed or exposed position, respectively. In particular, in the substantially enclosed position, as shown in FIG. 6, the bottom 602 of the PDA 320 rests against the curved bottom 304 of the pouch 210. The strap 332 passes through the slot 336 and the gusset 334, extends along the underside of the top face 302 and around the curved bottom 304 where it is in contact with the bottom 602 of the PDA. It then extends along the interior of the bottom face 206 to an attachment position 604 that is located at a length L above the bottom 304 (in a direction toward the top 324). The length L determines how far the PDA can be withdrawn from the top opening 324 by the strap 332. That is, as shown in FIG. 7, when the strap is pulled outwardly (arrow 502), the strap bottom 702 slides upwardly (arrow 704) away from the pouch bottom 304. It moves until it becomes adjacent to the attachment position 604, at which time further movement upwardly becomes limited as all slack in the strap (between the attachment position and the gusset slot 336) is removed. As noted above, the strap 332 should be formed from a low-friction material to allow easy sliding as it passes along the PDA bottom and PDA sides. In an illustrative embodiment, the length L can be from between 1 and 3 inches. However, this length is highly variable and a longer or shorter distance for L is expressly contemplated. Also in an illustrative embodiment, the strap is attached at the attachment position 604 using stitches 610. A variety of alternate attachment mechanisms including rivets, welds and adhesives can also be employed.

FIG. 8 shows an alternate embodiment for a pouch 802 that can be used in a padfolio or in another business accessory. Elements that are identical to those described above are provided with like reference numbers and are not further described. This alternate pouch includes a continuous material piece 804 extending from a top face 806 around a curved bottom 810 to a bottom face 808. A pair of side pieces (one being shown in fragmentary view) 812 join the top face 806 and the bottom face 808 together along the length of the pouch 802. This construction forms a self-contained pouch that does not utilize an interior side of the padfolio or other business accessory to be used as a bottom face. In this manner, it can be removed using, for example, a hook and loop fastener piece 814 that engages an opposing fastener piece (not shown) on the accessory. Similarly, it is contemplated that such a pouch can be provided with a belt loop/clip, a hook, a clasp and/or another convenient attachment device. In addition, while not shown, any of the pouches described herein can be provided with a top closure, consisting of either a full cover or a strap (such as shown for the telephone pocket).

The foregoing has been a detailed description of illustrative embodiments of this invention. Various modifications and additions can be made without departing from the spirit and scope thereof. For example, while the pouch with an electronic device ejector or extractor is shown in conjunction with the padfolio, it can be used in combination with a variety of business accessories including bags, totes, briefcases, purses and any other item that is typically carried by an individual and used to store items. To this end, the term "business accessory" shall be taken broadly to include all such items. Also, while terms such as top and bottom are used throughout this description, they are merely conventions and can be reversed. For example, the electronic device and be stored in the pouch upside down, wherein the device's true top and bottom are reversed for the purposes of the description. Finally, while the pouch is shown within the interior of a closing business accessory in this description, it is expressly contemplated that the pouch can be located in an outside location on a bag, folder or other business accessory. Accordingly, this description is to be taken only by way of example and not to otherwise limit the scope of the invention.

What is claimed is:

1. A pouch for storing an electronic device comprising:

a bottom face, a top face, a pouch bottom that joins the top face and the bottom face and a pair of sides that join the top face and the bottom face, each being sized and arranged to substantially enclose the electronic device with a top through which the electronic device passes into and out of the pouch, wherein the sides comprise a woven elastic material that is sized and arranged to stretch so as to expand a distance between the top face and the bottom face;

a strap that extends from the top face and that passes along an interior side of the top face, around an interior side of the pouch bottom and along an interior side of the bottom face to a predetermined attachment position, adapted so that the strap engages a bottom of the electronic device when the electronic device is substantially enclosed and that, when pulled, urges the bottom of the electronic device away from the pouch bottom to expose a top portion of the electronic device for grasping; and a reinforcing gusset positioned on an exterior side of the top face and including a slot through which the strap extends, the gusset extending along the exterior side of the top face from the slot toward the pouch bottom.

2. The pouch as set forth in claim 1 wherein the bottom face is attached to an inside of a cover of the padfolio having a pair hinged covers.

3. The pouch as set forth in claim 1 wherein each of the top face, bottom face and sides are sized and arranged to dimensions that substantially enclose a personal digital assistant.

4. The pouch as set forth in claim 1 wherein the strap includes an enlarged pull-tab at a free end.

5. The pouch as set forth in claim 4 wherein the strap is formed from a semi-rigid material with low-friction characteristics.

6. The pouch as set forth in claim 5 wherein the gusset is constructed from a soft pliable material.

7. The pouch as set forth in claim 6 wherein the soft pliable material comprises a soft polyvinylchloride.

8. The pouch as set forth in claim 1 wherein the bottom face includes, on an exterior-facing side, a fastener material for removably attaching the pouch to a surface of a business accessory.

* * * * *